US008096307B2

(12) United States Patent
Hafemann

(10) Patent No.: US 8,096,307 B2
(45) Date of Patent: Jan. 17, 2012

(54) HAIR STYLING ATTACHMENT AND HAIR STYLING DEVICE HAVING SUCH AN ATTACHMENT

(75) Inventor: Klaus Hafemann, Moers (DE)

(73) Assignee: Wik Far East Ltd., Hong Kong (CN)

( * ) Notice: Subject to any disclaimer, the term of this patent is extended or adjusted under 35 U.S.C. 154(b) by 250 days.

(21) Appl. No.: 12/641,233

(22) Filed: Dec. 17, 2009

(65) Prior Publication Data

US 2010/0147324 A1 Jun. 17, 2010

(30) Foreign Application Priority Data

Dec. 17, 2008 (DE) ..... 20 2008 016 618 U

(51) Int. Cl.
*A45D 20/08* (2006.01)

(52) U.S. Cl. ..... 132/271

(58) Field of Classification Search ..... 132/271, 132/223–232

See application file for complete search history.

(56) References Cited

U.S. PATENT DOCUMENTS

| | | | | |
|---|---|---|---|---|
| 6,895,975 | B2 | 5/2005 | Hafemann | |
| 2007/0107746 | A1* | 5/2007 | Randolph | 132/118 |

FOREIGN PATENT DOCUMENTS

| | | |
|---|---|---|
| DE | 20200971 | 6/2002 |
| EP | 1472951 | 4/2004 |
| WO | 03061416 | 7/2003 |

OTHER PUBLICATIONS

International Search Report for related European patent application 09177992.6 mailed Jan. 25, 2010.

U.S. Appl. No. 12/638,009, filed Dec. 15, 2009; First Named Inventor: Klaus Hafemann.

U.S. Appl. No. 12/639,775, filed Dec. 16, 2009; First Named Inventor: Klaus Hafemann.

* cited by examiner

*Primary Examiner* — Rachel Steitz

(74) *Attorney, Agent, or Firm* — Margaret Polson; Oppedahl Patent Law Firm LLC

(57) ABSTRACT

A hair styling attachment for connection to a device producing an air stream, such as an air curler, has two arms connected together with an articulated joint. The facing top sides of the arms have complementary working surfaces which form a hair styling gap. At least one arm is capable of motion about the pivot axis of the joint. The arm capable of motion is connected to a control lever extension within the hair styling attachment which is located on the opposite side of the pivot axis from its working surface and at an angle to the plane of the working surface. A first drive mechanism for adjusting this arm about the pivot axis acts on the control lever extension. The first drive mechanism is driven by a rotatably mounted first drive shaft, which connects it to a rotationally mounted second drive shaft of the device.

5 Claims, 1 Drawing Sheet

HAIR STYLING ATTACHMENT AND HAIR STYLING DEVICE HAVING SUCH AN ATTACHMENT

CROSS REFERENCE APPLICATIONS

This application claims the benefit of German Application No. 20 2008 016 618.7, filed Dec. 17, 2008, which is incorporated herein by reference for all purposes.

BACKGROUND

The present application relates to a hair styling attachment for connection to a device that produces an air stream, such as an air curler. A device according to the present application uses a fan to produce an air stream. The hair styling attachment has two arms connected with an articulated joint so they are adjustable relative to each other. The top sides of the arms, which face one another, have complementary working surfaces to form a hair styling gap. At least one of the arms includes at least one flow channel to convey an air stream supplied by the device. The working surface of at least one arm has air outlet openings connected to the flow channel which open into the hair styling gap.

Various hair styling devices that create an air stream may be used with various hair styling attachments for styling hair. These devices include hand-held devices, such as air curlers. Hair styling attachments for straightening or curling hair use two arms connected by an articulated joint which are adjustable in relation to one another in the manner of scissors or pliers. A hair styling gap, which is provided to receive the hair for styling, is located between the facing sides of these arms. The facing sides of the arms each have a working surface. With a hair styling attachment designed to be a so-called straightener, this working surface is subtaintially flat. There are also known hair styling attachments whose working surfaces have a wavy shape to create curls. The working surfaces of the two arms are designed to be complementary with regard to their contouring.

Typically, air flows through the arms of such hair styling attachments. The device that produces the air stream conveys the heat required for the hair styling operation through by heating the air which flows to the attachment. At least one of the two arms has a flow channel which opens into air outlet openings in its working surface. These air outlet openings convey the air stream provided by the fan in the device supply air to the hair to be styled. At the same time, this supply of air dries the hair, which is usually styled while damp.

In operation, a hair styling device of this type is typically held by a handle. A control lever operates the arms. The control lever preferably extends as far as possible up the device creating the air stream. Thus, the control lever can be operated by the hand holding the device. One-handed operation is desired. EP1334670A1, for example, shows a hair styling attachment of this variety.

The hand holding the device adjusts the power of the fan and/or triggers the release of ions, in addition to operating the articulated arm opening and closing the hair styling gap to insert and release hair. It would be desirable to simplify the handling of such a device.

The foregoing example of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

An aspect of the present application is to improve upon a generic hair styling attachment as defined in the introduction, such that operation of the articulated arm(s) is simplified.

A hair styling attachment according to the present application has two arms connected by a joint. At least one arm is capable of motion about the joint. A movable arm has a control lever extension on the opposite side of the articulated joint from the working surface. The control lever extension is located within the hair styling attachment at an angle to the plane of the working surface. A first drive mechanism acts on the control lever extension to adjust the arm about the axis of the articulated joint with respect to the other arm. A rotatably mounted first drive shaft moves the first drive mechanism. The first drive shaft has a coupling piece on the end opposite the first drive mechanism for connection to a rotatable second drive shaft located in the device.

The electric motor-driven second drive shaft in the device moves the first drive mechanism. The first drive mechanism then adjusts the arm or arms of the attachment. The at least one arm moving about the joint has a control lever within the hair styling attachment. This control lever is provided as an extension of the arm which carries the working surface beyond the axis of articulated joint. The control lever extension is mounted at an angle to the plane of the working surface, so that the arm can be adjusted about its axis of articulation by applying a tensile force or shear force acting on the lever extension. The first drive shaft of the hair styling attachment be a spindle drive, or a portion of a spindle drive, in addition to other conceivable embodiments. The output element of the spindle drive is rotatably uncoupled from the part roated by the drive shaft, but is mounted to be movable in the longitudinal axial direction within the hair styling attachment. This output element is connected to the control lever extension of the at least one arm movable about the joint with respect the other arm. Operation of the spindle drive in one direction or the other leads to a longitudinal shift of the drive element and thus to an adjusting movement of the arm, which is pivoted about its articulated axis as a result of this movement.

According to another embodiment, both arms of the hair styling attachment are connected to the shaft piece with an articulated joint, and each arm has a control lever extension inside the hair styling attachment on which the drive mechanism acts.

Opening and closing the hair styling gap is simplified with such a hair styling attachment because it can be operated with only a pushbutton or a slide switch on the hair styling device. The hair styling attachment connected to the device generating the air stream can therefore be operated to open and close the hair styling gap by the hand holding the device without the user having to change their grip. This presupposes that the operating button and/or switch for operation of the opening and closing movement of the arm(s) is arranged at a suitable location on the device.

Since such a hair styling attachment does not have an external operating lever for operating the arm(s), such a hair styling attachment is also especially suitable for rolling up hair if the attachment has a suitably contoured outer lateral surface of the arms.

In addition to the exemplary aspects and embodiments described above, further aspects and embodiments will become apparent by reference to the accompanying drawings forming a part of this specification wherein like reference characters designate corresponding parts in the several views.

Figure 1:
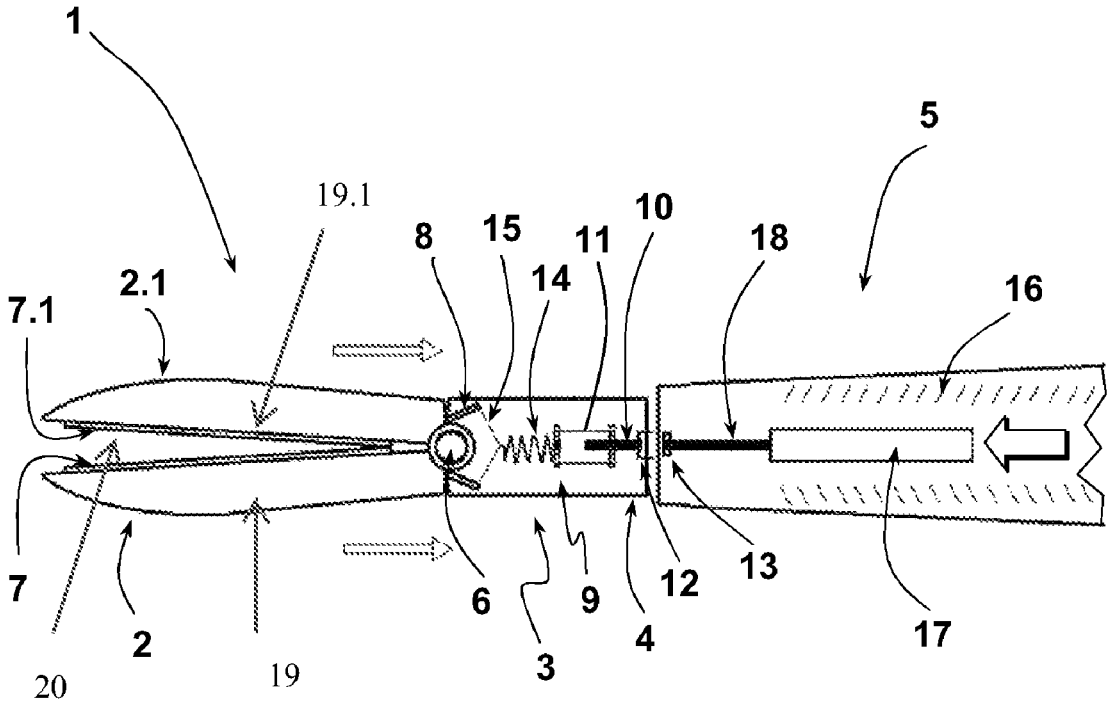
FIG. 1 is a partially cut-away schematic side view of the front section of a hair styling attachment comprising two arms connected by an articulated joint in an open position.

Before explaining the disclosed embodiment of the present invention in detail, it is to be understood that the invention is not limited in its application to the details of the particular arrangement shown, since the invention is capable of other embodiments. Exemplary embodiments are illustrated in referenced FIGURES of the drawings. It is intended that the embodiments and FIGURES disclosed herein are to be considered illustrative rather than limiting. Also, the terminology used herein is for the purpose of description and not of limitation.

DETAILED DESCRIPTION OF THE DRAWINGS

The device is explained in greater detail below on the basis of a depicted embodiment with reference to the accompanying FIG. 1. In a highly schematic diagram, FIG. 1 shows a hair styling attachment 1 comprising two arms 2, 2.1 that are connected by an articulated joint and are adjustable with respect to one another like pliers. The two arms 2, 2.1 are connected in an articulated joint to a shaft piece 3. The end of the shaft piece 3 opposite the two arms 2, 2.1 is designed as a coupling ring 4 to attach the hair styling attachment 1 to a device 5. In the disclosed embodiment, device 5 is an air curler which produces an air stream, in particular a hot air stream. The two arms 2, 2.1 meet at pivot axis 6.

In the depicted embodiment, the sides of the arms 2, 2.1 facing toward one another have a planar working surface 7, 7.1. Hair styling attachment 1 is a straightener in the depicted embodiment. The shaft piece 3 and the two arms 2, 2.1 are designed for air to flow through them, namely an air stream flowing over the coupling ring 4 into the hair styling attachment 1. Arms 2, 2.1 each have a flow channel 19, 19.1 for receiving the air stream supplied by the device 5, in particular a hot air stream. These flow channels open into openings 20 in the working surfaces 7, 7.1, so that the heat introduced through the air stream can be supplied to the hair in the hair styling gap between the arms 2, 2.1.

Arm 2 is described below with regard to its opening and closing movements. In the depicted embodiment, arm 2.1 has an identical design. In the depicted embodiment, arm 2 is opened and closed with a spindle drive. First drive mechanism 9 acts as the drive mechanism and spindle 14 acts as the output element. Arm 2 has a control lever extension 8 on the opposite side of the pivot axis 6 from its working surface 7. This control lever extension 8 is mounted inside the shaft piece 3 and therefore is not discernible from the outside. A first drive mechanism 9 for adjusting the arm 2 with respect to the arm 2.1 is located inside the shaft piece 3. In the depicted embodiment, the first drive mechanism 9 comprises a first drive shaft 10 connected to a threaded bushing 11 with an internal thread in a torque-locked manner. The first drive shaft 10 has a first coupling piece 12 on the end opposite the threaded bushing with which the first drive shaft 10 can be connected to a second coupling piece 13 of the device having a complementary design. The threaded bushing 11 is mounted inside the shaft piece 3 to rotate with the first drive shaft 10. The threaded bushing 11 sits on a threaded spindle 14, which is rotationally uncoupled from the threaded bushing 11 but is displaceably mounted in the longitudinal axial direction. The spindle 14 is connected to the control lever extension 8 via a link member 15. Link member 15 is connected to control lever extension 8 and spindle 14 with articulated joints, which allow both pushing and pulling movements to be transferred from the spindle 14 to the control lever extension 8. It is also possible to connect the spindle 14 to the control lever extension 8 by means of a wire cable piece rather than a rigid link member 15. In such an embodiment, a closing movement of the arm 2 is possible by means of the drive unit, whereas an opening movement takes place with spring force support.

The two coupling pieces 12, 13 are engaged with one another when the hair styling attachment 1 is attached to the device 3 in accordance with the two block arrows in FIG. 1. Coupling ring 4 holds the hair styling attachment 1 on the device 5. In the depicted embodiment, device 5 has a fan for producing an air stream. Furthermore, device 5 has a heating register 16 for heating the air stream produced by the fan. Device 5 also has a second drive mechanism 17 driven by an electric motor with a second drive shaft 18 on the end opposite drive mechanism 17. Second coupling piece 13 sits on the second drive shaft 18. The air stream produced in the device 5 and conveyed through this housing is labeled with a block arrow in the FIGURE. The air stream emerges from the device 5 and flows through the shaft piece 3 before entering the flow channels 19, 19.1 in the arms 2, 2.1 to be supplied then to the hair in the hair styling gap between the working surfaces 7, 7.1.

In use a button on the device 5 triggers the second drive mechanism 17 to close arms 2, 2.1 after hair is inserted in the styling gap. The rotational movement produced by the second drive mechanism 17 is sent to this first drive shaft 10 of the hair styling attachment 1 and then to the spindle drive comprised of first drive shaft 10 and spindle 14. In operation, the spindle 14 moves in the direction of the threaded bushing 11, resulting in a closing movement of the two arms 2, 2.1.

In the depicted embodiment, device 5 has an overload cutoff switch, so that the hair styling pressure acting on the hair does not exceed a cutoff level. If a certain load state is exceeded, the second drive mechanism 17 shuts down. Different pressures are needed for different hair types, so device 5 has a mechanism to adjust the aforementioned overload cutoff and/or the threshold value triggering the overload cutoff.

To release the styled hair, the second drive mechanism 17 of device 5 is triggered in the opposite direction to open arms 2, 2.1.

The present invention has been described on the basis of an exemplary embodiment. Without going beyond the scope of the claims, numerous other embodiments implementing the invention are derived for those skilled in the art without having to be explained explicitly.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true sprit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. In general the terms and phrases used herein have their art-recognized meaning, which can be found by reference to standard texts, journal references and contexts known to those skilled in the art. The above definitions are provided to clarify their specific use in the context of the invention.

LIST OF REFERENCE NUMERALS

1 Hair styling attachment
2, 2.1 Arm
3 Shaft piece
4 Coupling ring
5 Device
6 Pivot axis
7, 7.1 Working surface
8 Control lever extension
9 First drive mechanism
10 First drive shaft
11 Threaded bushing
12 First coupling piece
13 Second coupling piece
14 Spindle
15 Link member
16 Heating register
17 Second drive mechanism
18 Second drive shaft
19, 19.1 Flow channel
20 Air openings

I claim:

1. A hair styling attachment for connection to a device which produces an air stream, said hair styling attachment comprising:

two arms having top sides with complementary working surfaces facing one another to form a hair styling gap;

at least one flow channel in one of the two arms connected to air openings in the working surface of said arm;

said arms connected with an articulated joint, said articulated joint having an articulated axis;

wherein at least one arm is capable of motion around the articulated joint;

the at least one arm capable of motion has a control lever extension on the opposite side of the articulated axis from the working surface of said arm;

said control lever being at an angle to a plane of the working surface;

said control lever located within the hair styling attachment;

a first drive mechanism for adjusting the arm capable of motion about the articulated axis;

said first drive mechanism acting on the control lever extension;

said first drive mechanism being driven by a rotatably mounted first drive shaft; and said first drive shaft having a coupling piece on the end opposite the first drive mechanism for connecting the first drive shaft to a rotatably mounted second drive shaft of the device.

2. The hair styling attachment according to claim 1, wherein the first drive mechanism of the attachment has a spindle drive and where the output element of the spindle drive is connected to the control lever extension.

3. The hair styling attachment according to claim 2, wherein the spindle is part of the drive shaft or is the drive shaft, and a rotationally uncoupled drive element connected to the lever extension is mounted on the spindle.

4. The hair styling attachment according to claim 2, wherein:

a threaded bushing is part of the first drive shaft or is the drive shaft;

said threaded bushing is connected to the spindle such that the spindle is rotationally uncoupled from the bushing; and the spindle is connected to the control lever extension.

5. The hair styling attachment according to any of claims 1-4, wherein:

the arms of the hair styling attachment are connected with an articulated joint to a shaft piece of the attachment;

both arms have a control lever extension; and the two control lever extensions are connected to the first drive mechanism.

* * * * *